US008225934B1

(12) United States Patent
Malcolm et al.

(10) Patent No.: US 8,225,934 B1
(45) Date of Patent: Jul. 24, 2012

(54) CONTAINER SYSTEM

(76) Inventors: Carter T. Malcolm, Ann Arbor, MI (US); Jacqueline K. Malcolm, Ann Arbor, MI (US)

( * ) Notice: Subject to any disclaimer, the term of this patent is extended or adjusted under 35 U.S.C. 154(b) by 0 days.

(21) Appl. No.: 13/080,931

(22) Filed: Apr. 6, 2011

(51) Int. Cl.
*A45C 11/20* (2006.01)
*B65D 30/00* (2006.01)

(52) U.S. Cl. ..... 206/541; 190/1; 190/107; 383/4

(58) Field of Classification Search ..... 206/216, 206/541, 545, 546, 549, 577, 218; 190/1, 190/107, 115; 220/6, 7; 383/4, 6, 40, 97; 5/417, 420
See application file for complete search history.

(56) References Cited

U.S. PATENT DOCUMENTS 4,984,906 A * 1/1991 Little ..... 383/4
5,641,199 A * 6/1997 Bond-Madsen ..... 383/4
7,044,277 B2 * 5/2006 Redzisz ..... 190/107
7,278,539 B2 * 10/2007 Souza ..... 190/107
7,861,857 B2 * 1/2011 Vorderkunz ..... 190/115
2003/0221924 A1 * 12/2003 Tong ..... 190/107
2009/0057308 A1 * 3/2009 Rothschild et al. ..... 206/216
2010/0133141 A1 * 6/2010 Lebel et al. ..... 206/545

* cited by examiner

*Primary Examiner* — Luan K Bui
(74) *Attorney, Agent, or Firm* — Brinks Hofer Gilson & Lione

(57) ABSTRACT

A container system foldable into a placemat includes a front panel, a back panel, a center panel, and a border panel. The front, back, and border panels each include an inner edge and an outer edge. The center panel includes three inner edges and an outer edge. The center panel is foldably connected to the front, back, and border panels, such that a first inner edge of the center panel is adjacent to an inner edge of the front panel, a second inner edge of the center panel is adjacent to an inner edge of the back panel, and a third inner edge of the center panel is adjacent to an inner edge of the border panel. An attachment mechanism extends along the outer edges of the center, front, back, and border panels. The attachment mechanism allows closure of the container system to define the substantially enclosed interior space.

17 Claims, 7 Drawing Sheets

CONTAINER SYSTEM

BACKGROUND

1. Field of the Invention

The invention generally relates to container systems.

2. Description of Related Art

There are several inventions relating to the temporary storage of food for later consumption, such as lunchboxes. In the past, some lunchbox designs were made out of rigid material, such as metal or a hard plastic. Later developments in thermal insulation gave way to lunchboxes being made out of a softer material. The outside of these softer lunchboxes would generally be made of nylon, while the inside would generally be made of an easily cleanable water resistance material. Sandwiched between the nylon and water resistant materials would be a thermal insulator to better keep any food contained within the lunchbox at its original temperature.

However, while these soft lunchboxes were useful for the storage and transportation of food, they generally had limited use beyond this function. Further, if one had a need for a placemat, one would either need to carry the placemat separate from the lunchbox or place the placemat inside the lunchbox, taking valuable space which could be used for food storage.

SUMMARY

A container system foldable into a placemat includes a front panel, a back panel, a center panel, and a border panel. The front, back, and border panels each include an inner edge and an outer edge. The center panel includes three inner edges and an outer edge. The center panel may be foldably connected to the front, back, and border panels, such that a first inner edge of the center panel may be adjacent to an inner edge of the front panel. A second inner edge of the center panel may be adjacent to an inner edge of the back panel, and a third inner edge of the center panel may be adjacent to an inner edge of the border panel. An attachment mechanism extends along the outer edges of the center, front, back, and border panels. The attachment mechanism allows closure of the container system to define the substantially enclosed interior space.

In one embodiment, the attachment mechanism may include a starting point and an ending point. The starting point may be substantially adjacent to an intersection of the front, center, and border panels. The ending point may be substantially adjacent to an intersection of the back, center, and border panels. However, the starting point and the ending point may be located at any suitable location.

In another embodiment, the attachment mechanism may be a zipper tooth track system. In this embodiment, a zipper head engages the zipper tooth track system, so as to allow the opening and closing of the container system.

In yet another embodiment, the front panel and/or back panel may have a flap attached. When the flap is in a folded position, the flap can be stored within the container system. When the flap is unfolded, the flap functions to increase the surface area when the container system is unfolded into a placemat.

Further objects, features, advantages and embodiments of this invention will become readily apparent to persons skilled in the art after a review of the following description, with reference to the drawings and claims that are appended to and form a part of this specification.

DETAILED DESCRIPTION

Figure 1:
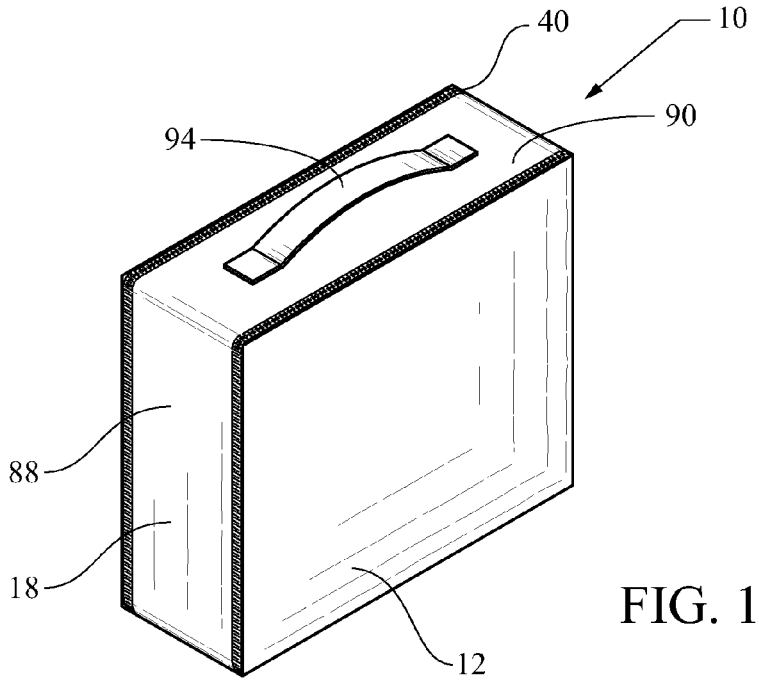
FIG. 1 illustrates a container system foldable into a placemat.
Figure 2:
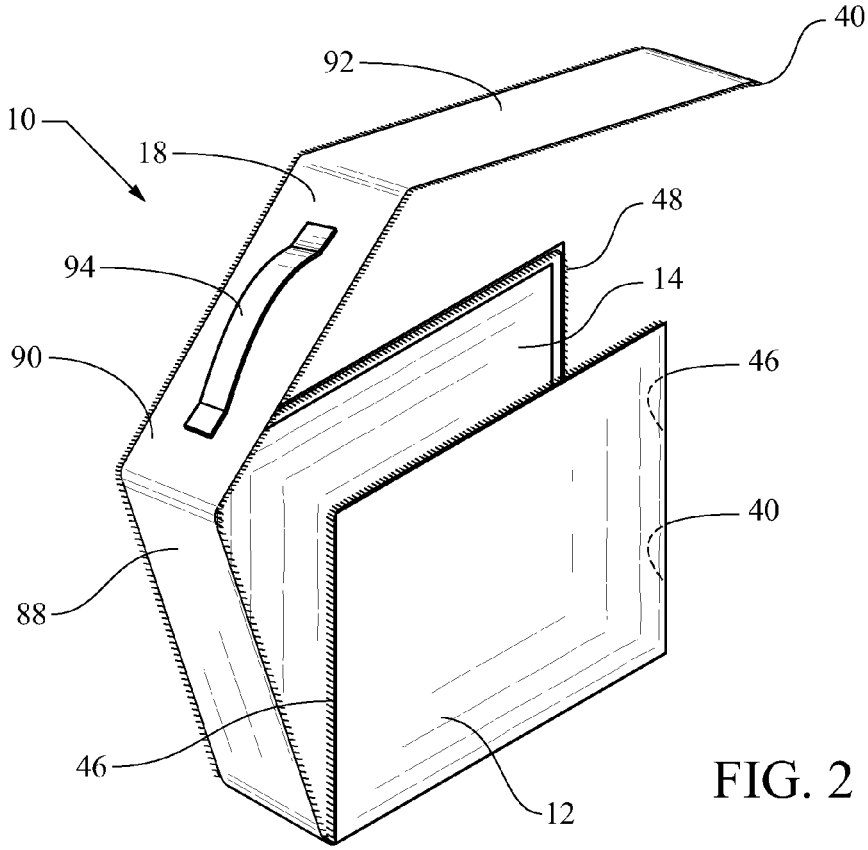
FIG. 2 illustrates the container system in the process of converting between a folded and an unfolded configuration.
Figure 3:
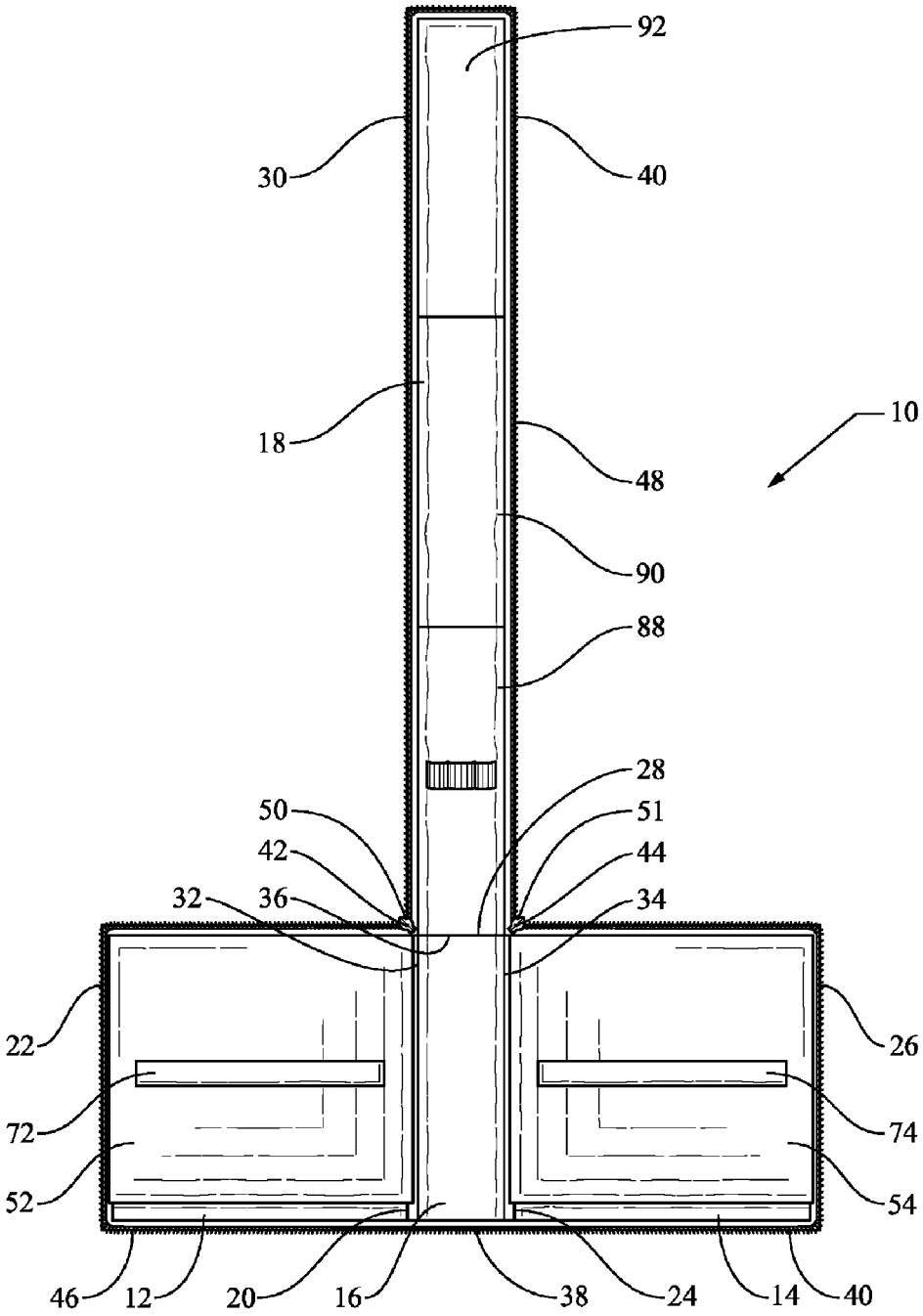
FIG. 3 illustrates a container system in the unfolded configuration.

Referring to FIGS. 1, 2, and 3, a container system 10 foldable into a placemat is shown. In FIG. 1, the container system 10 is illustrated in a folded configuration. In FIG. 2, the container system 10 is shown midway between the folded configuration of FIG. 1 and an unfolded configuration illustrated in FIG. 3.

Referring to FIGS. 2 and 3, the container system 10 includes a front panel 12, a back panel 14, a center panel 16, and a border panel 18. The front panel 12 includes an inner edge 20 and an outer edge 22. The back panel 14 includes an inner edge 24 and an outer edge 26. The border panel 18 includes an inner edge 28 and an outer edge 30. As to the center panel 16, the center panel 16 includes a first inner edge 32, a second inner edge 34, a third inner edge 36, and an outer edge 38.

The center panel 16 may be foldably connected to the front panel 12, the back panel 14, and the border panel 18. More specifically, the first inner edge 32 of the center panel 16 may be adjacent and foldably attached to the inner edge of the front panel 12. The second inner edge 34 of the center panel 16 may be adjacent and foldably attached to the inner edge 24 of the back panel 14. In like manner, the third inner edge 36 of the center panel 16 may be adjacent and foldably attached to the inner edge 28 of the border panel 18.

The front panel 12, back panel, 14, center panel 16 and border panel 18 may be rectangular in shape. However, as will be described in the paragraphs that follow, the front panel 12 and back panel 14 may be any suitable shape. The surface areas of the front panel 12 and back panel 14 may be substantially equal to one another. Additionally, the surface areas of the front panel 12 and/or back panel 14 may be larger than the surface area of the center panel 16. For example, the surface areas of the front panel 12 or back panel 14 may be greater than or equal to the surface area of the center panel 16.

The front panel 12, back panel, 14, center panel 16 and/or border panel 18 may be made of a flexible material, such as nylon. At least one side of the front panel 12, back panel, 14, center panel 16 and/or border panel 18 may be constructed of or covered by a water resistant material.

An attachment mechanism 40 extends along the outer edges 22, 26, 30, and 38 of the front panel 12, back panel 14, border panel 18, and the center panel 16, respectively. The attachment mechanism 40 has a starting point 42 and an ending point 44. The starting point 42 may be substantially adjacent to an intersection of the front panel 12, the center panel 16, and the border panel 18. The ending point 44 may be substantially adjacent to an intersection of the back panel 14, the center panel 16, and the border panel 18. However, the starting point and ending point 44 may be located at any suitable location. The attachment mechanism 40 allows closure of the container system 16 to define a substantially enclosed interior space 46.

The attachment mechanism 40 may include a first zipper tooth track 46 and a second zipper tooth track 48. The first zipper tooth track 46 starts at the starting point 42 and ends at the ending point 44, extending along the outer edges 22, 38, and 26 of the front panel 12, center panel 16, and the back panel 14, respectively. The second zipper tooth track 48 starts at the starting point 42 and ends at the ending point 44, extending along the outer edge 30 of the border panel 18. Further, the attachment mechanism 40 includes at least one zipper head 50 that engages the first zipper tooth track 46 and the second zipper tooth track 48 and is configured to attach and detach the first zipper tooth track 46 to the second zipper tooth track 48. Additionally, the attachment mechanism 40 may optionally include a second zipper head 51 that engages the first zipper tooth track 46 and the second zipper tooth track 48 and is configured to attach and detach the first zipper tooth track 46 to the second zipper tooth track 48.

While this embodiment discloses that the attachment mechanism 40 is a zipper system, it should be understood that any number of different attachment mechanisms may be used. For example, the attachment mechanism 40 may be a hook and loop fastener where the hook fastener is configured to removably engage the loop fastener. Additionally, the attachment mechanism 40 may be a series of buttons, snappable attachments, magnetic attachments or an adhesive attachment system.

Figure 4:
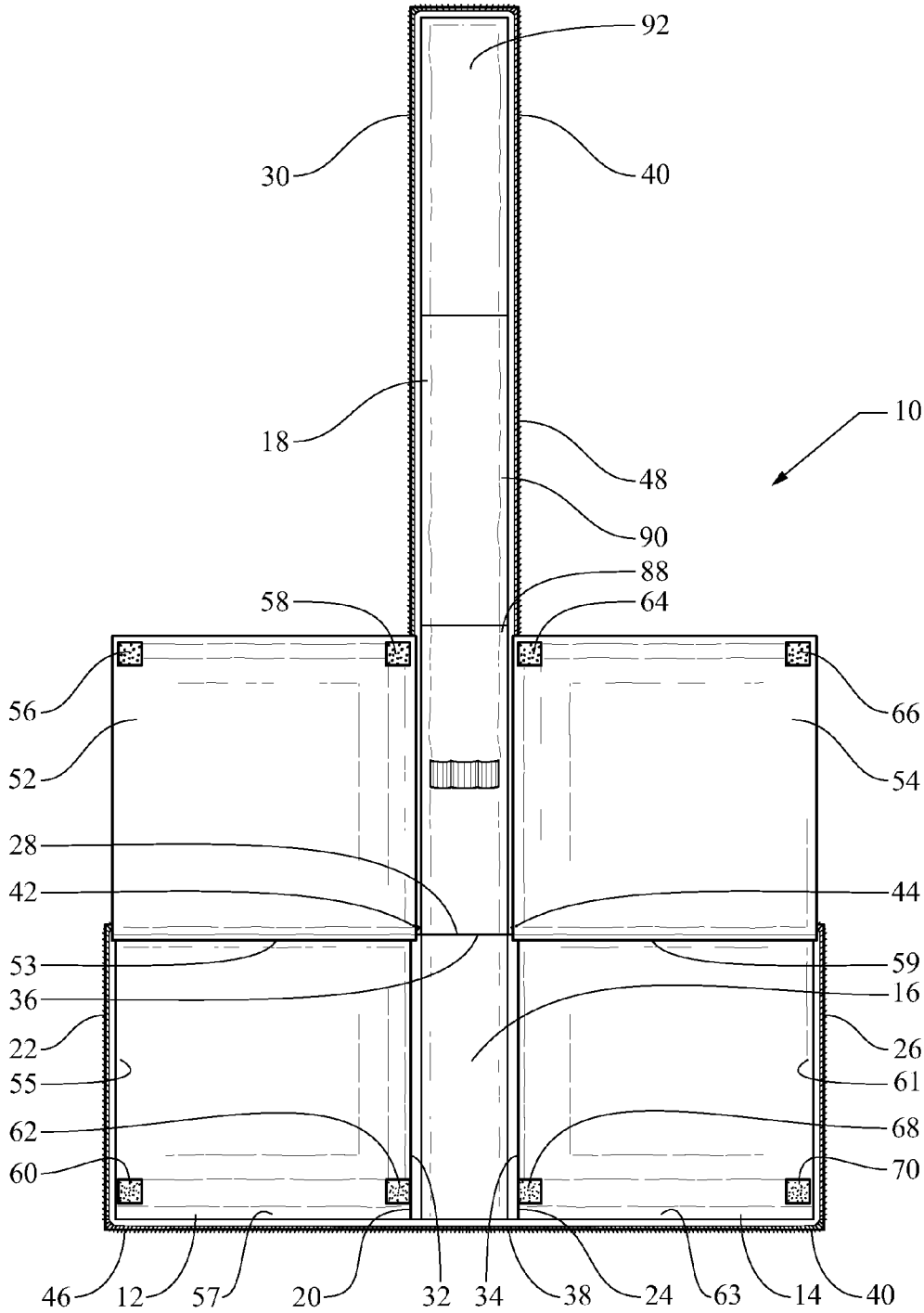
FIG. 4 illustrates the container system in the unfolded configuration having flaps unfolded.

Referring to FIG. 4, the container system 10 may further include a first flap 52 and a second flap 54. The first flap 52 may be foldably connected to the front panel 12. In like manner, the second flap 54 may be foldably connected to the back panel 16. The flaps 52 and 54 may be substantially similar in size and shape to the front panel 12 and the back panel 16. By unfolding the flaps 52 and 54 as shown in FIG. 4, the flaps 52 and 54 increase the surface area of the container system 10 when the container system 10 is in an unfolded configuration.

The first flap 52 further includes retainers 56, and 58, that mate with retainers 60 and 62 that are located on the first panel 12. When in a mating position, the first flap 52 is retained to the front panel 12, as best shown in FIG. 3. Similarly, the second flap 54 includes retainers 64 and 66, which mate to retainers 68 and 70 which are located on the back panel 16. When in a mating position, the second flap 54 is retained to the back panel 16.

The retainers 56, 58, 60, 62, 64, 66, 68, and 70 may be any type of retainer capable of holding the flaps 52 and 54 to the front panel 12 and back panel 16, respectively. Retainers 56, 58, 60, 62, 64, 66, 68, and 70, may be hook and loop fasteners, buttons, snaps, magnets, or adhesives, or any system capable of retaining the flaps 52 and 54 to the front panel 12 and the back panel 16, respectively.

Figure 5:
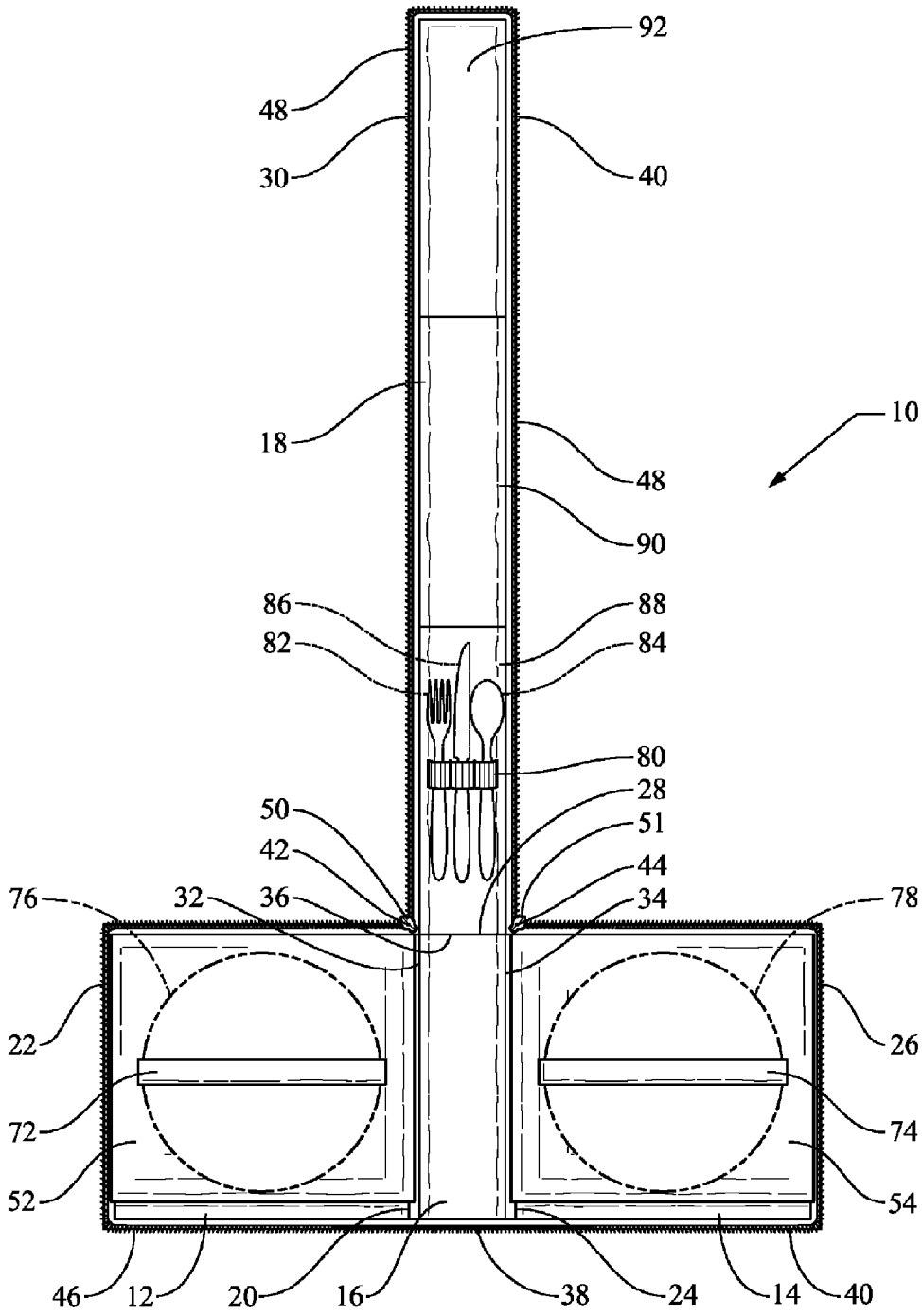
FIG. 5 illustrates the container system in the unfolded configuration having utensils and plates retained by retainers.

Referring back to FIG. 3, the system 10 may include retaining straps 72 and/or 74 attached to the first flap 52 and the second flap 54, respectively. As best shown in FIG. 5, the retaining straps 72 and 74 may be elastic straps capable of holding dishes, such as plates 76 and 78 flush with the first flap 52 and second flap 54, respectively. Still referring to FIG. 5, the system 10 may include a retaining strap 80 attached to the border panel 18 for retaining utensils. In this embodiment, the retaining strap 80 is retaining a fork 82, a spoon 84, and a knife 86.

Referring back to FIG. 4, the border panel 18 may be made up of three sections—a first section 88, a second section 90, and a third section 92. However, the border panel 18 may be made of any number of sections or even a single section. The size and shape of the center panel 16 may be substantially similar to the size and shape of the second section 90 of the border panel 18. A handle 94 may be attached to the second section 90 of the border panel 16, as best shown in FIG. 1. However, the handle 94 may be attached to the first section 88 or the third section 92 of the border panel 16. Further, the handle 94 may be attached to the center panel 16.

Figure 6:
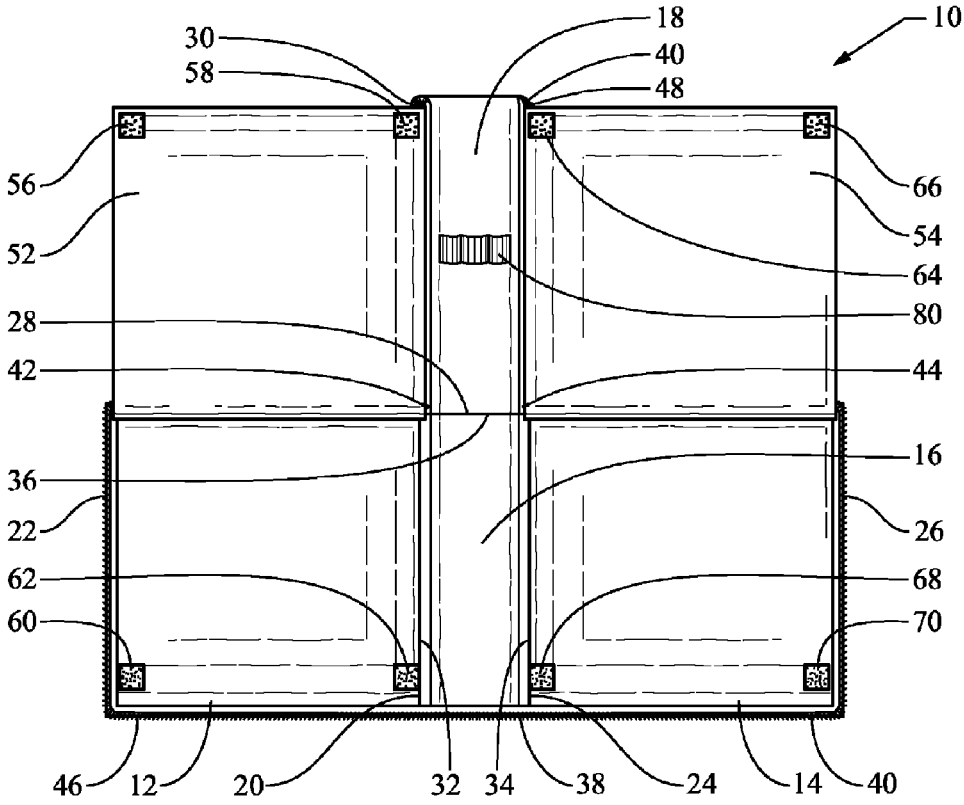
FIG. 6 illustrates the container system in an unfolded configuration, wherein a border panel of the container system is folded back behind portions of the container system.

The second section 90 may be foldably attached to the first section 88 and the third section 92. This allows the border panel 18 to be folded at the intersections between the second section 90 and the third section 92 and the intersection between the first section 88 and the second section 90. As best shown in FIG. 6, the second section 90 and the third section 92 are folded along the intersection between the first section 88 and the second section 90, allowing the second section 90 and third section 92 to be folded behind the system 10, forming a substantially rectangular placemat, when the flaps 52 and 54 are unfolded.

Figure 7:
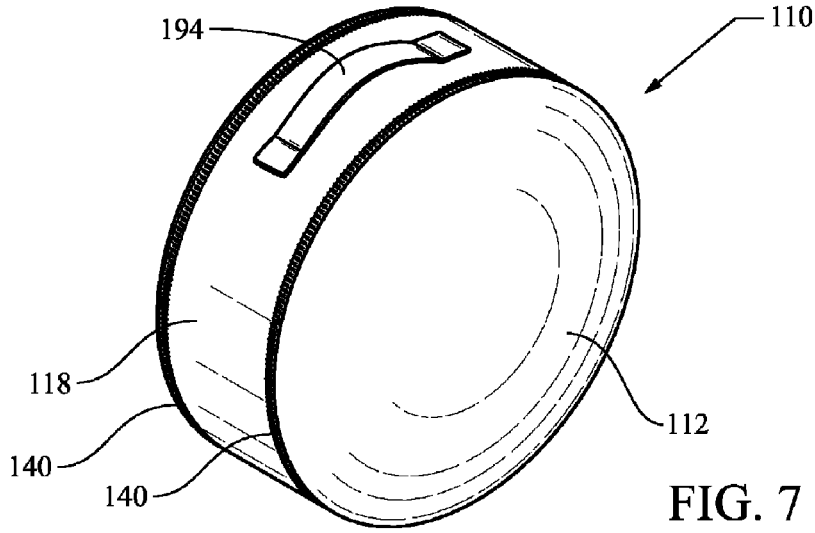
FIG. 7 is another embodiment of the container system, wherein the container system is a circular container system.
Figure 8:
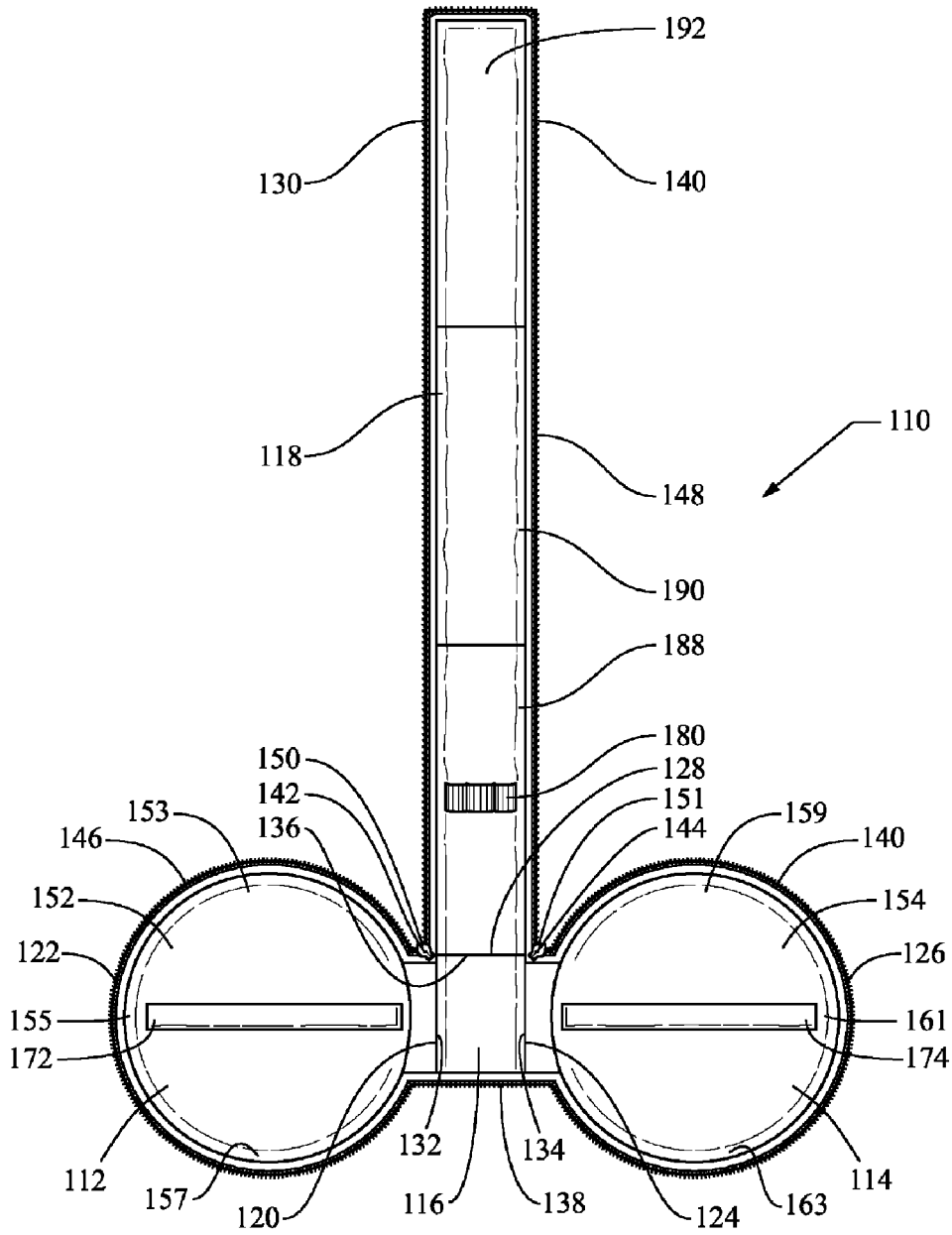
FIG. 8 illustrates the circular container system of FIG. 7 in an unfolded configuration.

As stated previously, the front panel 12 and back panel 16 may take a variety of different shapes. For example, referring to FIGS. 7 and 8, the front panel 112 and the back panel 114 are circular in shape. In FIGS. 7 and 8, similar reference numerals are used to refer to elements previously described in the embodiments shown in FIGS. 1-6. The reference numerals are similar with the exception that they have been incremented by 100. The description given previously regarding FIGS. 1-6 are equally applicable to the embodiment shown in FIGS. 7 and 8, with the exception that the front panel 112 and the back panel 114 are circular in shape.

Figure 9:
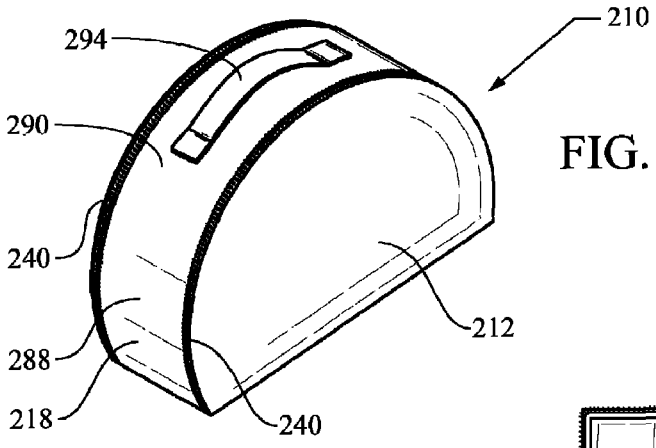
FIG. 9 illustrates another embodiment of the container system, wherein the container system is semicircular.
Figure 10:
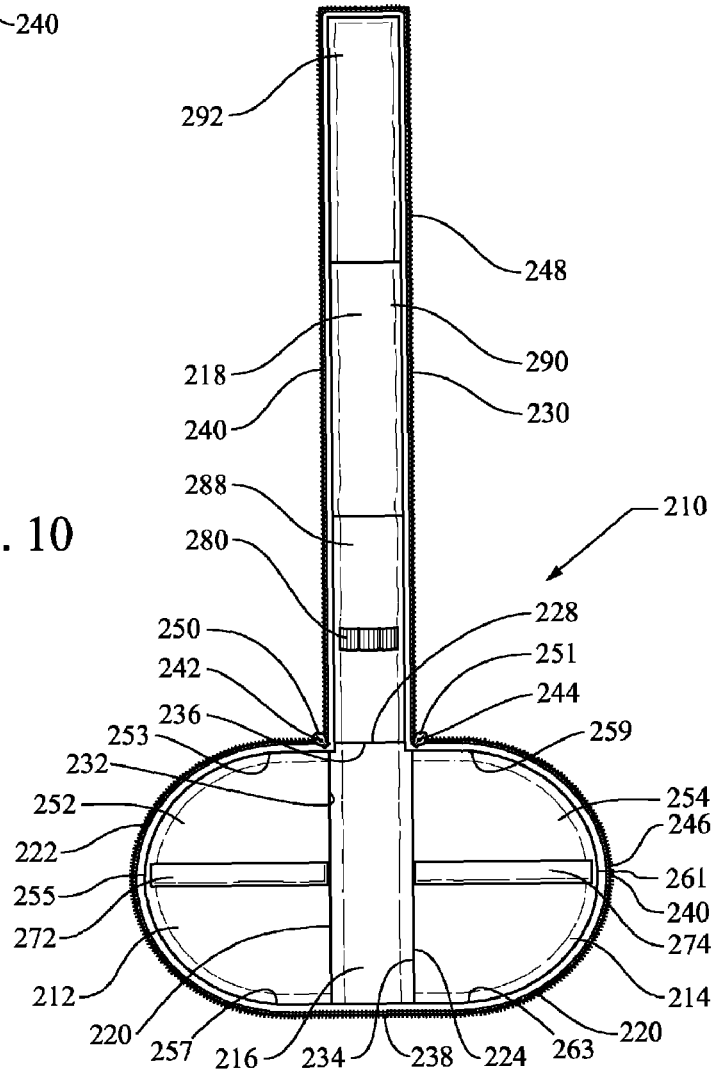
FIG. 10 is the semicircular container system of FIG. 9 in an unfolded configuration.

In another example, referring to FIGS. 9 and 10, the front panel 212 and the back panel 214 are semicircular in shape. In FIGS. 9 and 10, similar reference numerals are used to refer to elements previously described in the embodiments shown in FIGS. 1-6. The reference numerals are similar with the exception that they have been incremented by 200. The description given previously regarding FIGS. 1-6 are equally applicable to the embodiment shown in FIGS. 9 and 10, with the exception that the front panel 212 and the back panel 214 are semicircular in shape.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

The invention claimed is:

1. A container system foldable into a placemat comprising:

a front panel, a back panel, a center panel, and a border panel, wherein the front panel, back panel and border panel each include an inner edge and an outer edge, and wherein the center panel includes first, second and third inner edges and an outer edge;

the center panel being foldably connected to the front panel, back panel, and border panel such that the first inner edge of the center panel is adjacent to the inner edge of the front panel, the second inner edge of the center panel is adjacent to the inner edge of the back panel, the third inner edge of the center panel is adjacent to the inner edge of the border panel; and an attachment mechanism extending along outer edges of the center panel, front panel, back panel, and border panel, the attachment mechanism having a starting point being substantially adjacent to an intersection of the front panel, center panel and border panel and an ending point being substantially adjacent to an intersection of the back panel, center panel and border panel, wherein the attachment mechanism allows closure of the container system to define a substantially enclosed interior space, a flap foldably connected to the outer edges of each of the front and back panels, whereby the flaps can articulate between folded and unfolded configurations, wherein the flaps each unfold in a same direction and form a continuous surface between the front panel, back panel, center panel and flaps, a fastener associated with each of the flaps and the front and back panels, whereby the fasteners hold the flaps to the front or back panels when the flaps are in a folded configuration, and wherein the surface area of each of the front and back panels is at least twice the surface area of the center panel.

2. The container system of claim 1, wherein the front panel, back panel, center panel and border panel are substantially rectangular.

3. The container system of claim 1, wherein the attachment mechanism comprises a first zipper tooth track and a second zipper tooth track.

4. The container system of claim 3, further comprising a zipper head engaging the first and second zipper tooth tracks, the zipper head configured to attach and detach the first zipper tooth track to the second zipper tooth track.

5. The container system of claim 3 wherein the first zipper tooth track extends along the outer edges of the border panel and the second zipper tooth track extends along the outer edges of the front, back and center panels.

6. The container system of claim 1, wherein the attachment mechanism is a hook fastener and a loop fastener, wherein the hook fastener is configured to removably engage the loop fastener.

7. The container system of claim 1, further comprising a handle connected to the border panel.

8. The container system of claim 1, wherein the at least one of the front panel, back panel, center panel and border panel are made of a flexible material.

9. The container system of claim 1, wherein at least one side of the front panel, back panel, center panel, and border panel are at least partially constructed of or covered by a water resistant material.

10. The container system of claim 1, further comprising a retainer connected to at least one of the front panel, back panel, center panel and border panel for retaining an object when the system is in either a folded or unfolded configuration.

11. The container system of claim 1, wherein the border panel further comprises a first section, a second section, and a third section, wherein the second section is foldably connected to both the first and third sections.

12. The container system of claim 11, wherein the size and shape of the center panel is substantially similar to the size and shape of the second section of the border panel.

13. The container system of claim 1, wherein the size and shape of the front panel is substantially similar to the size and shape of the back panel.

14. The container system of claim 1, wherein the flaps in the unfolded configuration are located on opposing sides of the border panel.

15. A container system foldable into a mat comprising:

a front panel, a back panel, a center panel, and a border panel, wherein the front panel, back panel and border panel each include an inner edge and an outer edge, and wherein the center panel includes first, second and third inner edges and an outer edge, the center panel being foldably connected to the front panel, back panel, and border panel such that the first inner edge of the center panel is adjacent to the inner edge of the front panel;

the second inner edge of the center panel is adjacent to the inner edge of the back panel;

the third inner edge of the center panel is adjacent to the inner edge of the border panel; and a flap foldably connected to the outer edges of each of the front and back panels, whereby the flaps can articulate between folded and unfolded configurations, and wherein the flaps each unfold in a same direction and form a continuous surface between the front panel, back panel, center panel and flaps;

an attachment mechanism extending along outer edges of the center panel, front panel, back panel, and border panel, wherein the attachment mechanism allows closure of the container system to define a substantially enclosed interior space;

a fastener associated with each of the flaps and the front and back panels, whereby the fasteners hold the flaps to the front or back panels when the flaps are in a folded configuration; and wherein the surface area of each of the front and back panels is at least twice the surface area of the center panel.

16. The container system of claim 15, wherein the attachment mechanism is a first zipper tooth track and a second zipper tooth track and wherein the first zipper tooth track extends along the outer edges of the border panel and the second zipper tooth track extends along the outer edges of the front, back and center panels.

17. The container system of claim 15, wherein the flaps in the unfolded configuration are located on opposing sides of the border panel.

* * * * *